United States Patent [19]

Theurer et al.

[11] 4,075,814

[45] Feb. 28, 1978

[54] MODULAR HOUSING SYSTEM WITH PART OF THE MODULE SERVING AS A SHIPPING CONTAINER FOR THE REMAINDER OF THE MODULE

[75] Inventors: John Theurer, Alpine, N.J.; Orville F. Beck, Downingtown, Pa.; James T. Doherty, Pelham, N.Y.

[73] Assignee: Nesters Housing Company, Inc., Newark, N.J.

[21] Appl. No.: 689,341

[22] Filed: May 24, 1976

[51] Int. Cl.[2] ..... E04B 1/348

[52] U.S. Cl. ..... 52/79.5; 52/143

[58] Field of Search ..... 52/79, 143, 234, 236, 52/67

[56] References Cited

U.S. PATENT DOCUMENTS

| | | | |
|---|---|---|---|
| 668,827 | 2/1901 | Baker | 52/67 |
| 2,544,833 | 3/1951 | Hammond | 52/79 |
| 3,200,545 | 8/1965 | Bunge | 52/67 |
| 3,835,600 | 9/1974 | Padula | 52/79 |

FOREIGN PATENT DOCUMENTS

| | | | |
|---|---|---|---|
| 665,853 | 7/1963 | Canada | 52/67 |
| 976,190 | 3/1951 | France | 52/67 |
| 1,513,929 | 2/1968 | France | 52/79.1 |
| 2,238,813 | 2/1975 | France | 52/67 |
| 79,866 | 3/1952 | Norway | 52/67 |

*Primary Examiner*—Ernest R. Purser
*Assistant Examiner*—Henry Raduazo
*Attorney, Agent, or Firm*—Clarence A. O'Brien; Harvey B. Jacobson

[57] ABSTRACT

A housing system designed to be transported as one package has first and second sections each including a floor and a side wall disposed perpendicularly to one another. By proper arrangement, the sections, which are of substantially equal size, can be fitted into one another such that the floor and wall of each of the sections covers a surface of a substantially rectangular parallelepiped. In a similar manner, third and fourth sections, which are equal to one another in size and similar in construction to the first and second sections, but smaller in size than the latter sections, are arranged so as to form a second substantially rectangular parallelepiped which is received within the parallelepiped formed by the first and second sections. One of the first and second sections cooperates with one of the third and fourth sections to form a housing unit, with each module including a pair of such units. Roof panels are also stored within the container formed by the first and second sections and easily attached over the various sections once same are arranged into a two unit housing module to provide a roof for the module, while various partitions can be provided in a predetermined manner for dividing the interior of the housing units into various rooms.

6 Claims, 8 Drawing Figures

100'
100
68
76
14
34
52
56
58
16
88
64
50
62
60
66
18
90
78
40
12
38
70
102

68
100'
14
16
92
96
94
18
98
12
70
102
100

MODULAR HOUSING SYSTEM WITH PART OF THE MODULE SERVING AS A SHIPPING CONTAINER FOR THE REMAINDER OF THE MODULE

BACKGROUND OF THE INVENTION

1. Field of the Invention

This invention relates generally to a modular housing system, and particularly to a modular housing system which forms its own shipping container.

2. Description of the Prior Art

There are many regions of the world, such as certain areas in the middle east, that have need for housing units in substantial numbers, but lack not only the requisite raw materials for constructing housing, but also the labor skills to perform conventional on-site construction. Accordingly, a great demand has developed for inexpensive, yet substantial, prefabricated housing that can be shipped from manufacturing points in developed areas to semi-developed and un-developed areas where the housing units are needed.

It is known to construct prefabricated habitable structures which collapse in some manner during transport. Examples of such known habitable structures can be found in U.S. Pat. No.: 2,780,844, issued Feb. 12, 1957, to H. C. Bolt; U.S. Pat. No. 3,719,386, issued Mar. 6, 1973, to R. Puckett et al; U.S. Pat. No. 3,769,765, issued Nov. 6, 1973, to M. E. Wright; U.S. Pat. No. 3,832,811, issued Sept. 3, 1974, to E. M. Briel, Jr.; U.S. Pat. No. 3,835,600, issued Sept. 17, 1974, to A. H. Padula et al; and U.S. Pat. No. 3,872,631, issued Mar. 25, 1975, to W. M. Nowell. While these known collapsible prefabricated structures function well when towed or carried across modern highways, and the like, they are not necessarily intended to be shipped by marine transport across oceans without being provided with some sort of external protection.

It is generally known to containerize various modules to be used for constructing dwellings so that the modules are arranged within the area of a standard shipping container. By a standard shipping container is meant those conforming to the well-known ISO standards, and the like. An example of said a containerized module system can be found in U.S. Pat. No. 3,792,558, issued Feb. 19, 1974, to J. Berce et al. This known arrangement, however, provides only for putting modules into separate, specially configured hulls attached to a framework substantially in the form of a rectangular parallelepiped. Thus, several containers must be employed to ship all of the modules required for a single housing unit, and various elements of the unit, such as bathroom and kitchen fixtures, must be mounted in the housing unit at the erection site.

U.S. Pat. No. 3,900,994, issued Aug. 26, 1975, to C. Van der Lely, shows a prefabricated multi-story building made up of a plurality of boxshaped sections. Once again, however, each of these sections must be shipped separately, thus requiring a large number of separate shipments.

SUMMARY OF THE INVENTION

It is an object of the present invention to provide a modular housing system which can be transported to an erection site in one package.

It is another object of the present invention to provide a modular housing system wherein a part of the module forms a shipping container in which the module is transported to an erection site.

It is yet another object of the present invention to provide a modular housing system wherein two or more housing units are contained in a single module which is shipped as one package to an erection site.

These and other objects are achieved according to the present invention by providing a housing system having: a first section including a floor and at least one wall; and a second section also including a floor and at least one wall, the second section cooperating with the first section during transport of the housing system to form a shipping container substantially in the form of a parallelepiped.

According to a preferred construction of the invention, the first section and second section are of substantially equal size, with each of the first section and second section having the floor and wall thereof disposed at a perpendicular angle along respective peripheral edges of the sections. Further, a pair of end walls are disposed along end portions of the floor and wall at perpendicular angles thereto, with the result that the first mentioned wall forms a usually longitudinally extending side wall. When the sections are disposed so as to form a substantially rectangular parallelepiped, one of the end walls of the first and second section is disposed adjacent to and over an end wall of the other section, with the floor and side wall of each of the first and second sections being disposed in a respective one of the planar side surfaces of the resulting parallelepiped.

A package which is disposed within the aforementioned shipping container is formed from a third section and a fourth section each constructed in a manner similar to the first and second sections, and of substantially equal size to one another, but smaller than the first and second sections so as to be received therein. Each of the first and second sections associates with a respective one of the third and fourth sections to form a housing unit, with a pair of housing units being included in each module formed by the four sections. Prefabricated panels which form a roof for the pair of housing units can also be included within the shipping container, together with various other panels needed for finishing off the resulting module.

Once the various sections are unpacked from the shipping container configuration, the smaller third and fourth units are connected together back-to-back and are connected to the open side, or free edge of the floor, of respective ones of the first and second sections in order to form a pair of housing units which comprise a two unit module. It will be appreciated, that by carrying the basic concept even further, modules containing more than two units may be realized.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
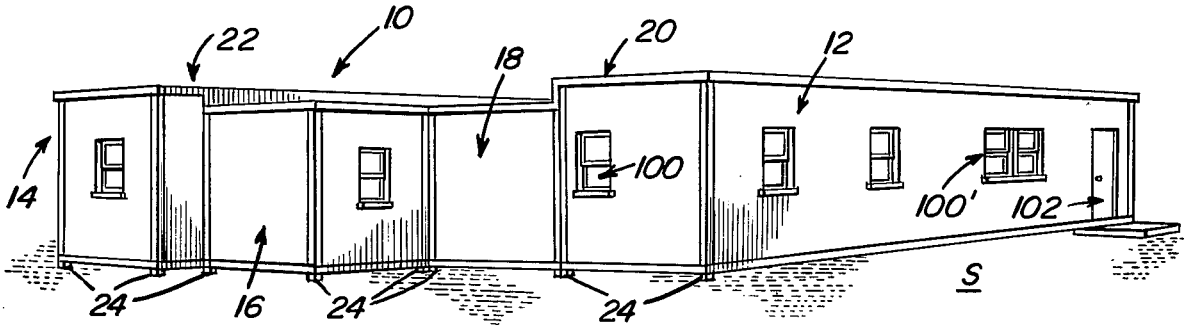
FIG. 1 is a schematic, perspective view showing a pair of housing units constructed from a two unit module according to the present invention.

Referring now more particularly to FIG. 1 of the drawings, a module 10 according to the present invention is shown as erected from a plurality of sections 12, 14, 16 and 18, so as to form a pair of complete living units 20 and 22, each constructed from a respective pair of sections 12, 14, 16 and 18. While module 10 is illustrated as including a pair of units 20 and 22, it is to be understood that a complete housing unit can also eiter exist by itself or be attached in a cluster or even more than two units. If only one unit is included in the module, it is, of course, inherent that the module and unit are synonymous. As shown in FIG. 1, and in the subsequent figures, a module 10 consists of two units, such as units 20 and 22, sharing plumbing, a common wall, or have some other dependency upon each other. Each of the sections 12, 14, 16 and 18 is actually one half of one living unit 20, 22.

The various sections 12, 14, 16 and 18 are preferably mounted on suitable supports provided at the erection site, such as the pad-like foundations 24 shown in FIG. 1.

Figure 2:
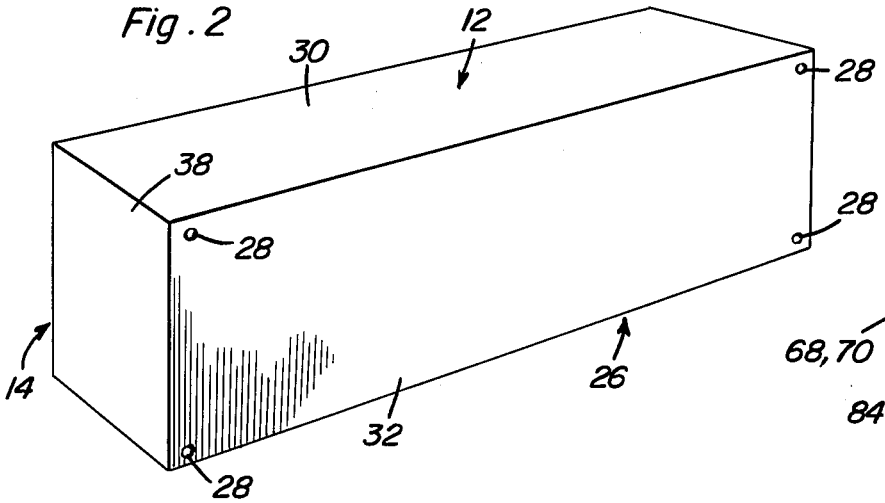
FIG. 2 is a schematic perspective view showing a housing system according to the present invention when arranged in the form of a shipping container during transport of the module to an erection site.

Referring now to FIG. 2, the packed form of a module 10 according to the present invention is shown wherein the sections 12 and 14 cooperate with one another to form a container 26 which is preferably dimensioned so as to conform to the size of a standard shipping container. ASA, ISO and Intermodal are examples of standards by which shipping containers are dimensioned. In each corner of container 26, both top and bottom, there is provided standard corner fittings 28 constructed into the end frame or portion of container 26. These fittings 28 will permit container 26 to be handled by all ASA, ISO and Intermodal handling equipment and tie-downs, so as to allow container 26 to be handled by conventional devices (not shown).

Lets assume that container 26 is a 40 foot long by 8 foot wide by 9 foot high container ready for shipping. This container 26 contains all the necessary components required for the assembly of one module 10 containing two family dwelling units 20 and 22. Each unit 20, 22 in the module 10 would contain, for example, one bedroom, one bath, a kitchen, a living area, and a study. See FIGS. 6 and 8. The floor plan arrangement is flexible and can be re-arranged to accommodate the particular needs of a module 10. These various floor plans may vary due to the use of the module.

Section 12 includes a floor 30 and a side wall 32, while section 14 includes a floor 34 (FIG. 3) and a cooperating side wall 36. The floors 30 and 34 and side walls 32 and 36 cooperate to occupy a respective planar surface of a rectangular parallelepiped which are formed by sections 12 and 14 when arranged as seen in FIG. 2. Further, each of the sections include respective end walls 38, 40 and 42, 44 which help enclose the ends of container 26. Thus, by having the floors 30, 34 and side walls 32, 36 of each of the sections 12, 14 disposed at a perpendicular or right angle along respective peripheral edges of one another, and by further including the respective pairs of end walls 38, 40 and 42, 44, which are themselves disposed at right angles to the respective floors 30, 34 and side walls 32, 36, an arrangement is formed wherein one of the end walls of each of the sections 12 and 14 is disposed adjacent to and over an end wall of the other sections 14, 12 to form a rectangular parallelepiped which forms the container 26 used during transport of the module 10.

A package 46 is contained within the container 26, and is constructed in a manner similar to the construction of container 26 by cooperating sections 16 and 18, each of which includes a floor 48 and side wall 50 and a floor 52 (FIG. 6) and cooperating side wall 54. These sections 16 and 18 also include respective end walls 56, 58 and 60, 62, so that they essentially constructed in a similar manner to the sections 12 and 14, but are smaller in size so as to be received within sections 12 and 14 when the latter are disposed so as to form container 26. As can be seen from FIG. 4, the sections 16 and 18 also come apart to form complementary portions of each of the housing units 20 and 22. Room dividers 64 and 66 are integral with the sections 16 and 18, as by attachment to the respective floors 48 and 52 and side walls 50 and 54, so as to provide a partition area within the resulting housing unit 20, 22 for a, for example, bathroom, and the like.

Figure 5:
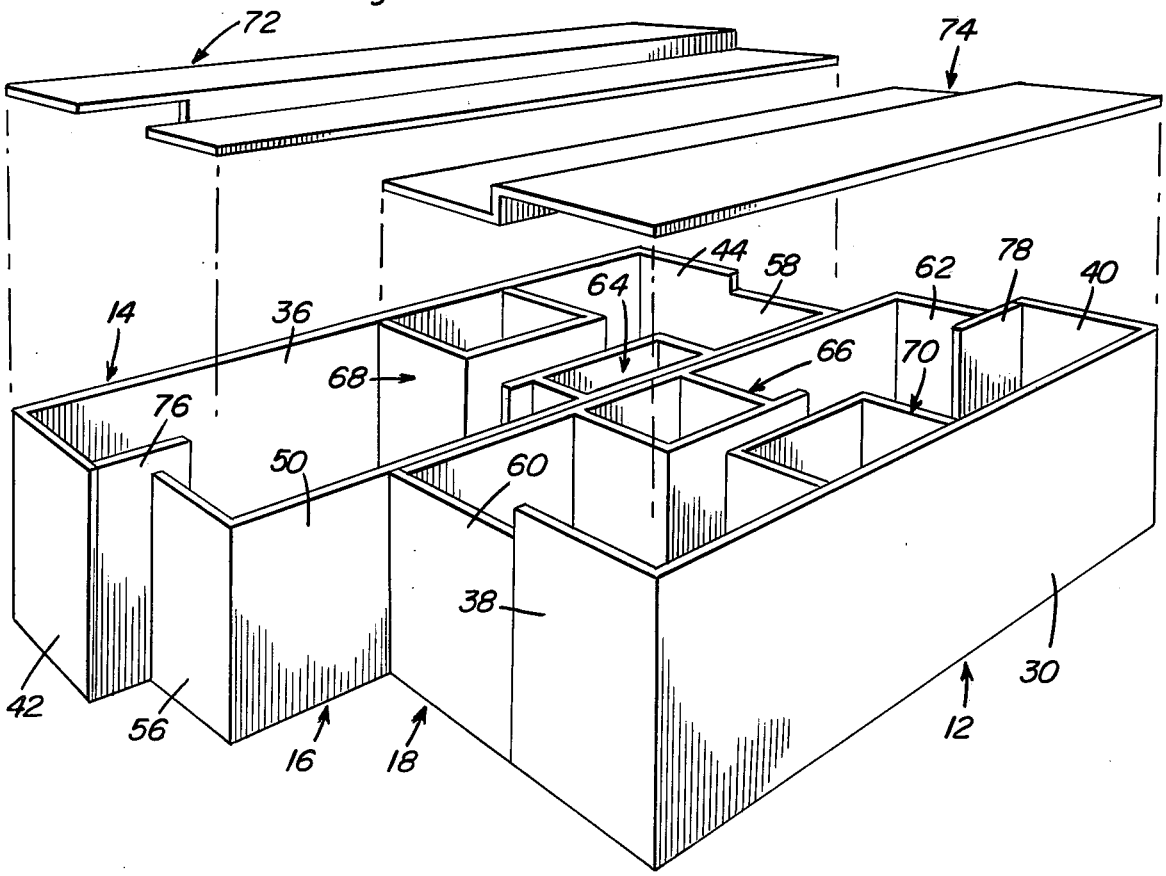
FIG. 5 is an exploded, schematic perspective view showing the final assembly stage during erection of a housing module formed from the container shown in FIG. 2.
Figure 6:
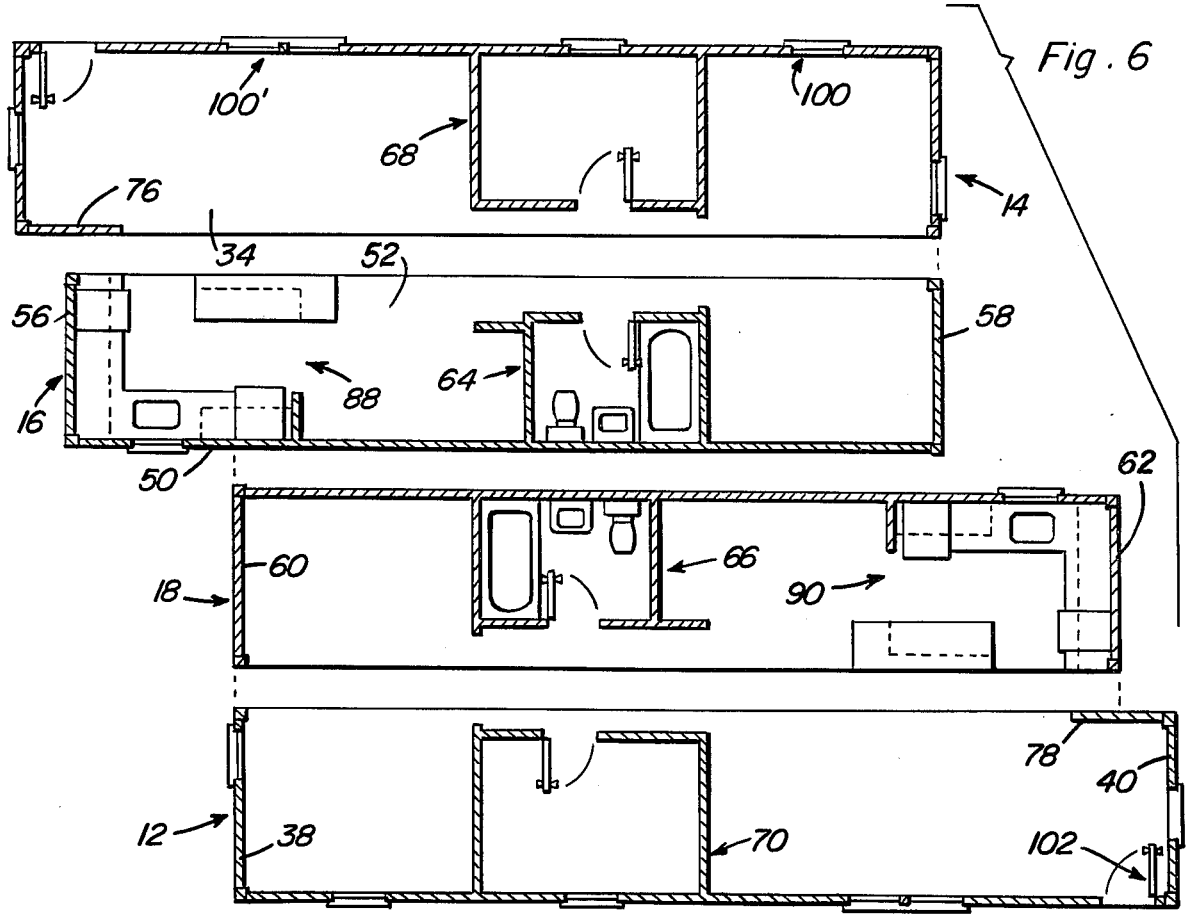
FIG. 6 is an exploded, horizontal sectional view showing one floor plan of a pair of housing units constructed from a module as formed by the shipping container shown in FIG. 2.

FIGS. 5 and 6 show the final stage of erection of a module 10 from a container 26 in one possible floor plan of several which can be realized.

In the floor plan arrangement of the module 10 as shown in FIGS. 5 and 6, it can be seen that room dividers 68 and 70 are added to the walls 30 and 36 of sections 12 and 14 after the package 46 has been removed from the separator sections 12 and 14. These room dividers 68 and 70 can be prefabricated as, for example, a plurality of panels easily snapped or otherwise connected together so as to be stored within the container 26 during shipment. Also stored within container 26 during shipment are a pair of roof panels 72 and 74 which form a roof for each of the housing units 20 and 22. While specific attachment means for roof panels 72 and 74 to their associated sections 12, 18 and 14, 16 are not shown in the drawings, it is to be understood that conventional connecting means such as commonly employed in conjunction with sheet metal, wood panels, and the like, may be employed. Various filler panels, such as the illustrated panels 76 and 78 are also stored within container 26 during shipment for completing the side walls of the module 10, and connection of these panels 76 and 78 may also be made in a conventional manner.

Figure 7:
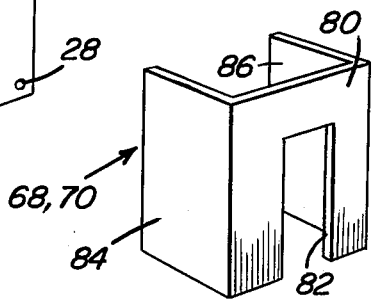
FIG. 7 is a perspective view showing a detail of a room divider which may be employed with the prefabricated modular housing units according to the present invention.

Referring to FIG. 7, it will be seen that the room dividers 68 and 70 are formed from, for example, three separate pieces, with one of the pieces forming a wall 80 provided with a suitable doorway 82 and the other of the pieces forming the side walls 84 and 86. While specific manner of interconnecting the various walls 80, 84 and 86 is not shown in FIG. 7, it will be appreciated that once again conventional connecting devices can be employed.

Figure 8:
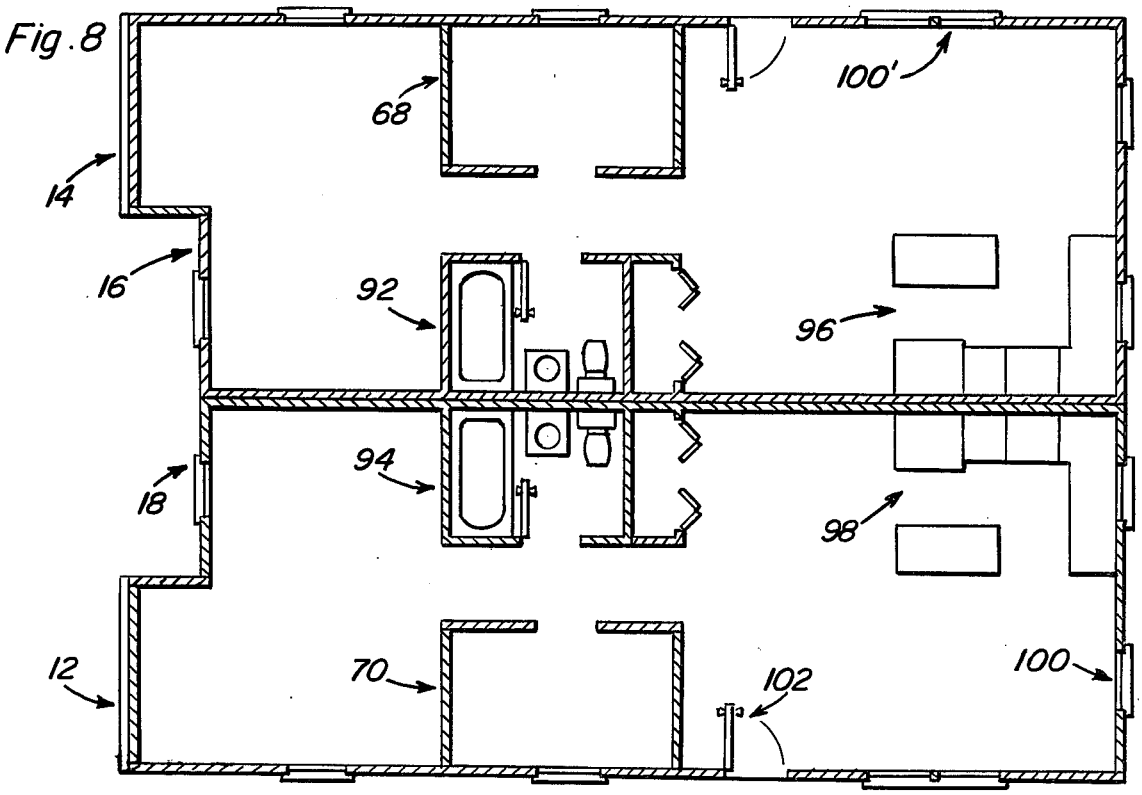
FIG. 8 is a horizontal sectional view showing another possible floor plan for a pair of housing units constructed from a container, such as shown in FIG. 2.

Referring now to FIG. 8 in conjunction with FIG. 6, it will be seen that in FIG. 6 the kitchens 88 and 90 are at opposite sides of the module, while in the modified floor plan of FIG. 8, the bathrooms 92 and 94 are slightly rearranged from the bathrooms formed by the room dividers 64 and 66 as shown in FIG. 6, and the kitchens 96 and 98 are immediately opposite one another in order to facilitate plumbing. It will be appreciated that various other floor plans can be devised within the basic module 10.

Referring again to FIG. 3, the first stage of unpacking container 26 is seen. This is accomplished by removal of section 12, which is one half of the living unit 20, and exposes the package 46 which was disposed within the container 26. The package 46, which is comprised of sections 16 and 18, is approximately, for example, 6 inches to 8 inches smaller than the container 26 in overall size. This allows package 46 to be received within the container 26. Further, regardless of what floor plan is ultimately taken, the interior partitions, such as room dividers 64 and 66, must be offset from the center of their respective sections 16 and 18 in order that they may be disposed side-by-side within the package 46. See FIG. 4. This arrangement must also be done to accommodate any other interior partitions (not shown), or any exterior partitions (not shown), so that the partitions will not interfere with one another.

Figure 3:
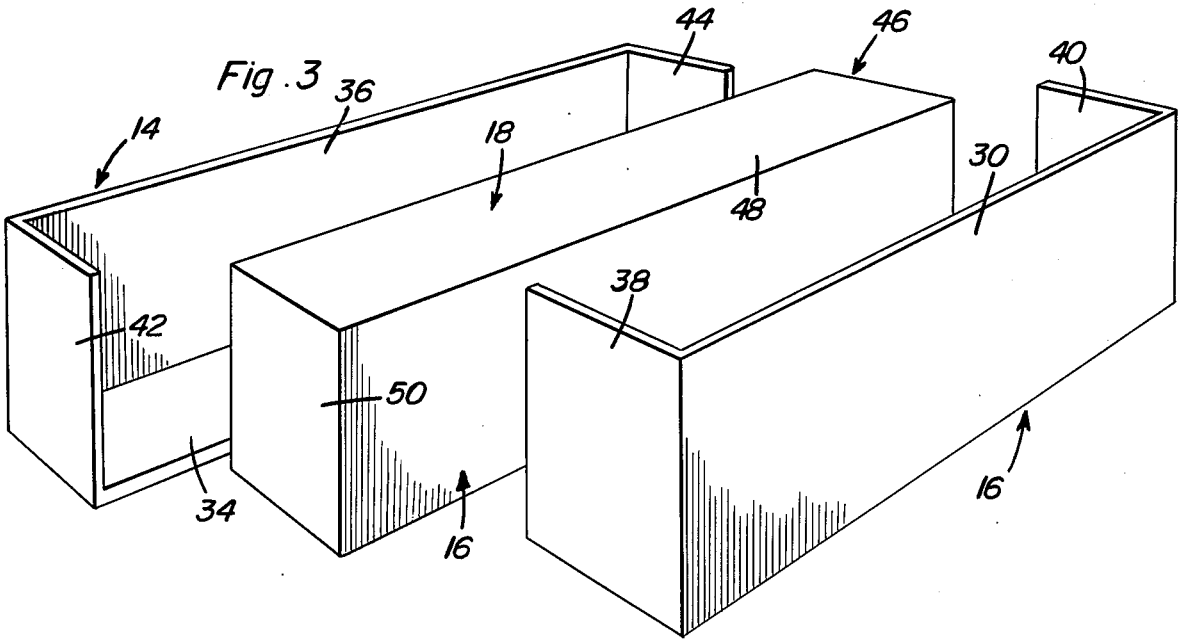
FIG. 3 is an exploded, schematic perspective view showing a first stage in unpacking of the shipping container of FIG. 2.

Thus, FIG. 3 shows sections 12 and 14 unpacked and in place. These sections would then be secured to the foundation columns, such as those foundations designated 24, they are to be placed on. Package 46 located in the center of the figure is ready to be unpacked in the same fashion as previously done for container 26.

Package 46 houses the kitchen and bath facilities for both housing units. It is designed to be unpacked and set in place without the need for major partition assemblies. The rooms in each section 16, 18 by-pass one another along the two sections to be folded into one package 46. All plumbing and electrical fixtures are preferably ready for hook-up at the erection site.

Figure 4:
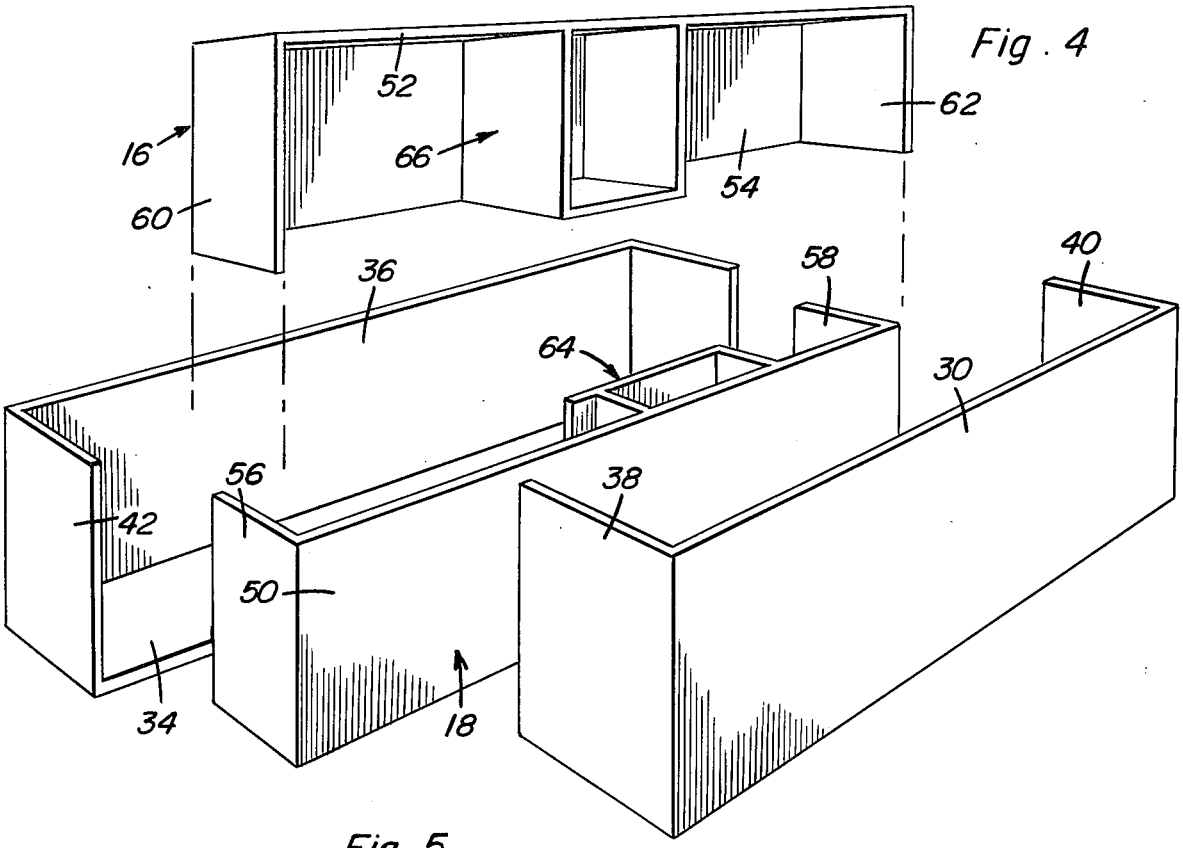
FIG. 4 is an exploded, schematic perspective view showing the unpacking stage of the container of FIG. 2 subsequent to the stage shown in FIG. 3.

FIG. 4 shows the separation of sections 16 and 18. Section 16 is then butted up against section 14 to form one unit, while section 18 rotates 90° counterclockwise, for example, and is positioned against section 12 to form the other unit 20. All the sections would now be resting on the foundations 24. FIG. 4 also indicates how the bathrooms and kitchens (FIG. 6) by-pass each other when packaged.

FIG. 5 shows the four sections 12, 14, 16 and 18 positioned to create two living units 20 and 22. Three partition panels for each unit 20, 22 are then assembled as described above at the site to form the room dividers 68 and 70, which may be study rooms, and the like, and are inserted into their respective sections 12 and 14 as from above (not shown). The various other partitions, such as the roof panels 72 and 74, which can be in several pieces, and the filler panels 76 and 78, which are shipped inside the container 26 as flat panels, are, for example, snapped together in the field in a manner not shown. Thus, in the manner described above, a two living unit module is quickly and easily constructed at the erection site.

As can be appreciated from the above description and from the drawings, a complete housing module according to the invention provides a housing system which can be packaged and transported to an erection site as a single unit. This one container can contain all the component parts necessary for complete assembly on the site, therefore reducing the number of shipments. All the building elements can be packaged in one standard shipping size container.

All windows 100, 100' and doors 102 are framed into the walls as part of the sub-assembly process. They will be positioned and installed in the walls prior to any packaging illustrated in the proposal and covered if necessary during shipment in a manner not shown. Doors are preferably steel doors disposed flush with the wall, and the windows can be single plate.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A housing system designed to be transported as a single package, comprising, in combination:

a. a first section including a floor and at least one wall;

b. a second section also including a floor and at least one wall, the second section cooperating with the first section during transport to form a container substantially in the form of a parallelepiped, the first section and second section being of substantially equal size, with each of the first section and second section having the floor and wall thereof disposed perpendicularly along respective peripheral side edges thereof and further including a pair of end walls disposed along end portions of the floor and wall at perpendicular angles thereto, one of the end walls of each of the first section and second section being disposed adjacent to and overlying an end wall of the other section, with the walls of the first section and second section being side walls, the first section and second section interfitting with respect to one another to form a rectangular parallelepiped and the end walls being disposed in the planes of the ends of the parallelepiped;

c. a third section including a floor and at least one wall; and d. a fourth section including a floor and at least one wall, the fourth section cooperating with the third section during transport to form a package substantially in the form of a parallelepiped, the package formed by the third section and the fourth section being smaller in size than the container formed by the first section and the second section and disposed within the container, each of the first section and second section being provided with openings variously forming doors and windows of a building constructed partially from each section, the third section and fourth section being provided with partitions offset from one another when the third section and fourth section are arranged cooperating with one another during transport to form a package substantially in the form of a parallelepiped.

2. A structure as defined in claim 1, wherein the first section and the second section are dimensioned to form a rectangular parallelepiped the size of a standard shipping container, and are provided with standard corner fittings in end portions of the container for facilitating handling and tieing down of the container by conventional shipping container handling equipment.

3. A structure as defined in claim 1, further including a plurality of filler panels disposed within the package during transportation, the filler panels being attachable to one another to form partitions within the first section and the second section when each section partially forms a building.

4. A housing system designed to be transported as a single package, comprising, in combination:

a. a first section including a floor and at least one wall;

b. a second section also including a floor and at least one wall, the second section cooperating with the first section during transport to form a container substantially in the form of a parallelepiped, the first section and second section being of substantially equal size, with each of the first section and second section having the floor and wall thereof disposed perpendicularly along respective peripheral side edges thereof and further including a pair of end walls disposed along end portions of the floor and wall at perpendicular angles thereot, one of the end walls of each of the first section and second section being disposed adjacent to and overlying an end wall of the other section, with the walls of the first section and second section being side walls, the first section and second section interfitting with respect to one another to form a rectangular parallelepiped and the end walls being disposed in the planes of the ends of the parallelepiped;

c. a third section including a floor and at least one wall; and d. a fourth section including a floor and at least one wall, the fourth section cooperating with the third section during transport to form a package substantially in the form of a parallelepiped, the package formed by the third section and the fourth section being smaller in size then the container formed by the first section and the second section and disposed within the container, the third section and fourth section being of substantially equal size, with each of the third section and fourth section having the floor and wall thereof disposed perpendicularly along the respective peripheral edges thereof and further including a pair of end walls disposed along end portions of the floor and wall at perpendicular angles thereto, one of the end walls of each of the third section and fourth section being disposed adjacent to and overlying an end wall of the other section, with the walls of the third section and fourth section being side walls, the third section and fourth section being arranged in cooperative engagement to form a rectangular parallelepiped during transport of the housing system, with the floors and side walls of the third section and fourth section being disposed in planar side planes of the parallelepiped and the end walls of the third section and fourth section being disposed in end planes of the parallelepiped, each of the first section and second section being provided with openings variously forming doors and windows of a building constructed partially from each section, the third section and fourth section being provided with partitions offset from one another when the third section and fourth section are arranged cooperating with one another during transport to form a package substantially in the form of a parallelepiped.

5. A structure as defined in claim 4, wherein the first section and the second section are dimensioned to form a rectangular parallelepiped the size of a standard shipping container, and are provided with standard corner fittings in end portions of the container for facilitating handling and tieing down of the container by conventional shipping container handling equipment.

6. A structure as defined in claim 4, further including a plurality of filler panels disposed within the package during transportation, the filler panels being attachable to one another to form partitions within the first section and the second section when each section partially forms a building.

* * * * *